US007985320B2

(12) United States Patent
Olmos Ruiz et al.

(10) Patent No.: US 7,985,320 B2
(45) Date of Patent: Jul. 26, 2011

(54) SECURITY OR SPECIAL PAPER WITH INTERNAL TACTILE RECOGNITION ELEMENTS

(75) Inventors: Antonio Olmos Ruiz, Madrid (ES); Juan Antonio Rubio Sanz, Madrid (ES); Javier Baraja Carracedo, Madrid (ES)

(73) Assignee: Fabrica Nacional de Moneda y Timbre-Real Casa de la Moneda (ES)

( * ) Notice: Subject to any disclaimer, the term of this patent is extended or adjusted under 35 U.S.C. 154(b) by 900 days.

(21) Appl. No.: 11/911,075

(22) PCT Filed: Apr. 6, 2005

(86) PCT No.: PCT/ES2005/000180

§ 371 (c)(1),
(2), (4) Date: Oct. 9, 2007

(87) PCT Pub. No.: WO2006/106156

PCT Pub. Date: Oct. 12, 2006

(65) Prior Publication Data

US 2008/0173417 A1 Jul. 24, 2008

(51) Int. Cl.
*D21H 21/40* (2006.01)

(52) U.S. Cl. ..... 162/140; 162/158; 428/313.3; 428/316.6

(58) Field of Classification Search ..... 428/221, 428/313.3, 316.6; 162/140; 283/48.1–60.2
See application file for complete search history.

(56) References Cited

U.S. PATENT DOCUMENTS

| | | | | | |
|---|---|---|---|---|---|
| 3,941,634 | A | | 3/1976 | Nisser et al. | 156/79 |
| RE30,061 | E | * | 7/1979 | Shepherd | 156/78 |
| 4,268,615 | A | * | 5/1981 | Yonezawa | 430/320 |
| 5,125,996 | A | * | 6/1992 | Campbell et al. | 156/196 |
| 5,169,435 | A | * | 12/1992 | Sherman et al. | 106/31.78 |
| 5,325,781 | A | * | 7/1994 | Dupont et al. | 101/487 |
| 5,650,217 | A | * | 7/1997 | Skrivanek et al. | 428/195.1 |
| 6,352,769 | B1 | * | 3/2002 | Mori | 428/354 |

FOREIGN PATENT DOCUMENTS

| | | |
|---|---|---|
| EP | 0 526 396 | 2/1993 |
| FR | 2 316 078 | 1/1977 |
| GB | 2 307 487 | 5/1997 |
| WO | WO 03/018323 | 3/2003 |

OTHER PUBLICATIONS

PCT Int'l Search Report dated Nov. 25, 2005 issued in corresponding PCT Int'l Appln. No. PCT/ES2005/000180.
PCT Int'l Preliminary Report dated Mar. 30, 2007 issued in corresponding PCT Int'l Appln. No. PCT/ES2005/000180.
European Office Action issued Oct. 29, 2009 in corresponding European Patent Application No. 05 734 206.5.

* cited by examiner

*Primary Examiner* — Eric Hug
*Assistant Examiner* — Dennis Cordray
(74) *Attorney, Agent, or Firm* — Ostrolenk Faber LLP

(57) ABSTRACT

Applicable to be used to issue notes of legal tender or any other type of document to facilitate its tactile recognition or prevent its falsification. It consists of a sheet of paper in which expanding agents have been inserted, either centered heightwise or near the upper surface and/or lower surface thereof, forming a figure or inscription which, upon application of pressure and heat, either during the paper manufacturing phase or subsequent processes, cause the sheet of paper to expand, thereby forming a curved and continuous embossing on the surface of the document.

12 Claims, 1 Drawing Sheet

SECURITY OR SPECIAL PAPER WITH INTERNAL TACTILE RECOGNITION ELEMENTS

CROSS REFERENCE TO RELATED APPLICATION

The present application is a 35 U.S.C. §§371 national phase conversion of PCT/ES2005/000180, filed Apr. 6, 2005, the disclosure of which has been incorporated herein by reference. The PCT International Application was published in the Spanish language.

OBJECT OF THE INVENTION

The present invention relates to security paper or special paper, which can be used as a medium for a document, note or any other format, which includes embossed drawings or shapes for its tactile recognition and authentication.

The object of the invention is to insert a series of expanding agents into the security paper or special paper, distributed in such a way as to form different geometries such as figures or inscriptions, the volume of which expands when the document is subjected to pressure and heating, producing a series of swellings that will comprise the characteristic embossing of said document. The aim is to facilitate recognition of the document based on this medium by tactile means and prevent its falsification, verifying by means of touch that the embossing corresponds to the reference embossing that identifies said document.

This security element is specially indicated to help blind people recognize or validate notes.

BACKGROUND OF THE INVENTION

The application of special, heat-sensitive inks to an object, on the surface of which a drawing or inscription is embodied, and subjecting these to heat or radiation is known to produce thickening of the drawing or inscription outline, which remains raised with respect to the rest of the surface.

These types of ink can be used for merely decorative purposes to confer a distinctive character on garments, cartons, metal plates or papers, amongst others, or can also be used to transmit a message written in Braille for recognition by, and the education of, blind people.

Invention patent EP 0 526 396 indicates that the ink may be colourless or of a specific colour or colours, is applied to a surface and subjected to drying at a lower temperature than that of expansion, after which it is possible to apply a varnish, and is finally subjected to energetic radiation, such as laser radiation, to heat the surface, which causes expansion of the ink.

Similarly, printing systems are applied to notes of legal tender on which ink layers of adequate thickness form figures that remain embossed to facilitate their identification by blind people. Said embossing stands out in prominent relief with respect to the horizontal surface of the note, due to which it suffers wear as a consequence of handling, finally making the embossing barely perceptible to blind people, who will be unable to recognize said note.

On the other hand, the use of expandable microspheres in paper production is known to increase its volume and thickness, while maintaining original weight and rigidity. Volume increase in the range of 18% to 22% can be obtained by using said microspheres, thereby achieving substantial savings on the cost of the pulp required to obtain the same volume.

These types of microsphere have a diameter of approximately 10 to 12 microns and a thermoplastic coating composition that encompasses an expanding agent in such a way that, when said microspheres are heated, the thermoplastic coating becomes elastic, the internal agent becomes gasified and the microsphere expands up to 4 or 5 times its original diameter.

We must point out that the microspheres are mixed with the paper fibres and tend to expand at a given temperature, before the union between said fibres is sufficiently rigid so as to prevent said expansion, the microspheres being sufficiently resistant so as to support the mechanical tensions that occur at higher temperatures.

DESCRIPTION OF THE INVENTION

The security paper or special paper of the present invention is based on the selective application of expanding agents to specific areas of the paper mass that react to heat and pressure, producing swellings that raise said areas with respect to the rest of the sheet of paper formed with identifying characteristics for its tactile recognition.

The application of heat or pressure will be carried out indistinctly during the paper manufacturing phase or subsequent processes.

The final document thus formed may consist of a note or other type of security document, designed to facilitate its tactile recognition and prevent its falsification, which will be recognized or authenticated when, by means of touch, its embossing is proven to correspond to the reference embossing and code that identifies said document.

The expanding agent may be applied to specific internal or external areas of the paper, forming different geometries and figures or inscriptions, the volume of which expands when the document is subjected to pressure and heating. These elements may be located at random, towards one side or recorded.

The expanding agent may be inserted in the centre of a thin sheet of paper and expand upwards and downwards, in such a way that its upper and lower surfaces are embossed respectively, or the expanding agent may be located internally near one of the surfaces, in such a way that only one side of the sheet is embossed.

The embossing formed on the sheet of paper through the expanding effect of the agent has a curvature and continuity with respect to the horizontal surface of the sheet that minimizes the possibilities of wear. Its use in notes provides a substantial advantage over the previously described systems that use printing processes to form the security embossing, as they allow blind people to identify a note even in the case of well-worn notes, as said notes will not suffer the wear to which conventional notes are subjected, the embossing of which is formed by printing systems.

DESCRIPTION OF THE DRAWINGS

In order to complement the previous description and further explain the characteristics of the invention, a set of drawings is included in which a preferred embodiment of said invention has been represented in an illustrative and non-limitative manner.

PREFERRED EMBODIMENT OF THE INVENTION

The security paper or special paper of the present invention can be used to issue notes of legal tender or any other type of document to facilitate its tactile recognition or prevent its falsification, and consists fundamentally of a sheet of paper (1) in which expanding agents (2) have been inserted, forming a figure or inscription, which cause the sheet of paper (1) to expand, thereby forming a curved and continuous embossing (3) on the document surface, upon application of pressure and heat, either during the paper manufacturing phase or subsequent processes.

Figure 1:
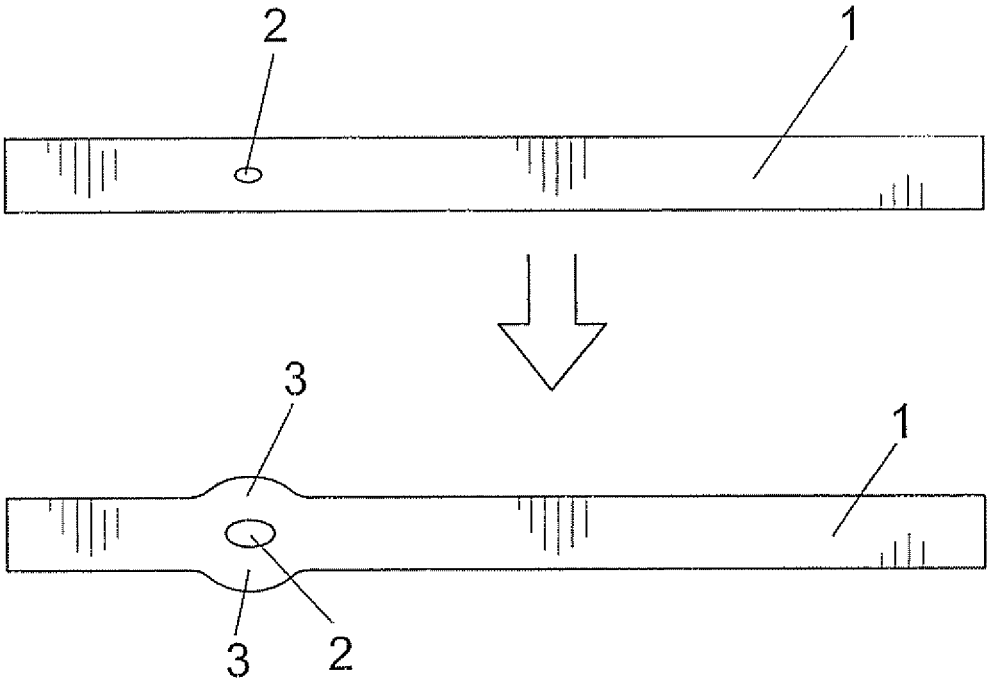
FIG. 1 shows a side view representing a sheet of paper on which an expanding agent has been inserted in a central position, below which said sheet of paper is represented with the embossing formed on its upper and lower surfaces as a consequence of the expansion of said agent.

Said expanding agents (2) may be centered heightwise on the sheet of paper (1), as shown in FIG. 1, the expansion of which forms an embossing (3) in correspondence to its position on the upper surface and lower surface of the sheet of paper (1).

Figure 2:
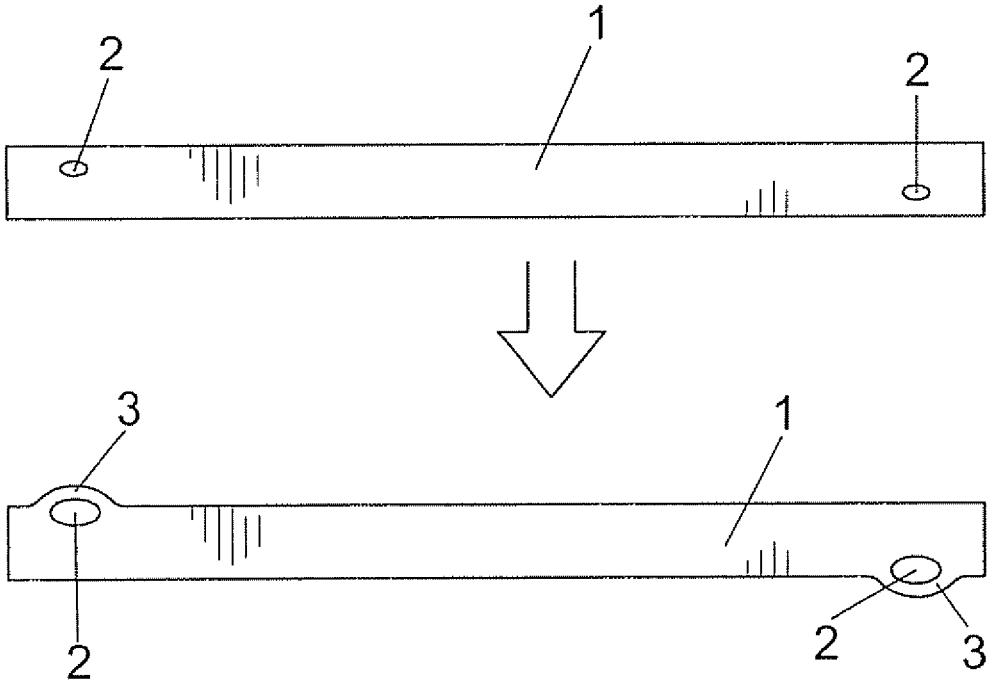
FIG. 2 shows a side view of a sheet of paper in which we can observe expanding agents distributed near its upper and lower surfaces, below which the sheet of paper is represented with the embossing formed on its upper and lower surfaces as a consequence of the expansion of said agents.

The expanding agents (2) may also be inserted near the upper surface and/or lower surface of the sheet of paper (1), as shown in FIG. 2, the expansion of which forms an embossing (3) on the side nearest said agents.

The location of said expanding agents within the sheet of paper may be random, towards one side or recorded.

In either case, we can observe in FIGS. 1 and 2 that the embossing (3) formed is smooth and curved, providing a continuity with respect to the horizontal surface of the sheet of paper (1), with object of minimizing its wear so as to facilitate its recognition by blind people.

The invention claimed is:

1. A paper with internal tactile recognition elements suitable for use in notes of legal tender or any other type of document to facilitate its tactile recognition or prevent its falsification, comprising:

a sheet of paper in which expanding agents have been selectively inserted in specific internal areas of the paper mass, forming a figure or inscription, which cause the sheet of paper to expand in correspondence to the position of the expanding agents, thereby forming a curved and continuous embossing on one or more surfaces of the sheet, upon application of pressure and heat, either during the paper manufacturing phase or subsequent processes.

2. The paper with internal tactile recognition elements, according to claim 1, wherein the expanding agents are centered heightwise on the sheet of paper, the expansion of which forms an embossing in correspondence to its position on the upper surface and lower surface of the sheet of paper.

3. The paper with internal tactile recognition elements, according to claim 1, wherein the expanding agents are inserted near the upper surface or lower surface of the sheet of paper, the expansion of which forms an embossing on surface nearest said expanding agents.

4. The paper with internal tactile recognition elements, according to claim 1, to which pressure and heat has been applied during the paper manufacturing phase, thereby expanding said expanding agents.

5. The paper with internal tactile recognition elements, according to claim 1, wherein the sheet of paper comprises a substantially homogenous paper mass, into which said expanding agents are inserted.

6. A method for forming a security paper or special paper with internal tactile recognition elements suitable for use in notes of legal tender or any other type of document to facilitate its tactile recognition or prevent its falsification, said paper consisting of a sheet of paper in which expanding agents have been inserted, forming identifying characteristics for its tactile recognition, said method comprising the steps of:

applying the expanding agents selectively to specific internal areas of the paper mass;

applying heat and pressure to expand said expanding agents and produce swellings that raise specific areas on one or more surfaces of the sheet with respect to the rest of the sheet of paper in correspondence to the position of said expanding agents, to form said identifying characteristics for its tactile recognition.

7. The method according to claim 6, wherein said heat and pressure are applied during the paper manufacturing phase.

8. The method according to claim 6, wherein said heat and pressure are applied subsequent to said paper manufacturing phase.

9. The method according to claim 6, wherein said swellings raise said specific areas to produce curved and continuous embossings constituting said identifying characteristics for tactile recognition.

10. The method according to claim 6, wherein said expanding agents are centered heightwise on the sheet of paper, so that the swelling forms an embossing in correspondence to its position on the upper surface and lower surface of the sheet of paper.

11. The method according to claim 6, wherein the expanding agents are inserted near at least one of the upper surface and the lower surface of the sheet of paper, so that the swelling forms an embossing on the surface nearest said expanding agents.

12. The method according to claim 6, wherein the expanding agents are applied to said specific areas of the paper mass so as to form a figure or inscription.

* * * * *